US011976875B2

(12) United States Patent
Kim et al.

(10) Patent No.: US 11,976,875 B2
(45) Date of Patent: May 7, 2024

(54) REFRIGERATOR

(71) Applicant: LG ELECTRONICS INC., Seoul (KR)

(72) Inventors: Jun Yeong Kim, Seoul (KR); Hyung Kyu Park, Seoul (KR); Jae Seok Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/356,089

(22) Filed: Jun. 23, 2021

(65) Prior Publication Data

US 2022/0057134 A1 Feb. 24, 2022

(30) Foreign Application Priority Data

Aug. 20, 2020 (KR) ..... 10-2020-0104315

(51) Int. Cl.
*F25D 23/06* (2006.01)
*F25B 39/02* (2006.01)

(52) U.S. Cl.
CPC ..... *F25D 23/063* (2013.01); *F25B 39/02* (2013.01); *F25D 23/067* (2013.01)

(58) Field of Classification Search
CPC ..... F25D 23/063; F25D 23/067; F25D 25/02; F25D 19/00; F25D 23/066; F25D 23/08; F25D 23/021; F25D 23/028; F25D 2500/02; F25D 23/064; F25D 2201/12; F25B 39/02
USPC ..... 312/408
See application file for complete search history.

(56) References Cited

U.S. PATENT DOCUMENTS 2,291,547 A 7/1942 Giffard
3,923,355 A * 12/1975 Dietterich ..... B32B 15/046 312/406.1
3,940,195 A * 2/1976 Tillman ..... F25D 23/067 312/406.1

(Continued)

FOREIGN PATENT DOCUMENTS

CN 102455105 5/2012
EP 2 719 981 4/2014

(Continued)

OTHER PUBLICATIONS

European Search Report dated Jan. 7, 2022 issued in EP Application No. 21183903.0.

(Continued)

*Primary Examiner* — Miguel A Diaz
*Assistant Examiner* — Ibrahim A. Michael Adeniji
(74) *Attorney, Agent, or Firm* — KED & ASSOCIATES, LLP

(57) ABSTRACT

A refrigerator has a shelf seating protrusion and a separate shelf seating member. The shelf seating protrusion is not formed at an approximate mid-point, height wise, of a storage space defined by an inner casing. The shelf seating member may be coupled to the inner casing to support a shelf assembly. An arrangement of the shelf seating protrusions and the shelf seating member is configured to reduce deformation and cracking of the inner casing due to thermal impact in a manufacturing process or when items are stored on the shelf assembly.

19 Claims, 16 Drawing Sheets

(56) References Cited

U.S. PATENT DOCUMENTS

| | | | | |
|---|---|---|---|---|
| 4,048,274 | A * | 9/1977 | Hoge | B32B 25/045 264/261 |
| 2002/0037240 | A1* | 3/2002 | Okada | A61L 9/015 422/124 |
| 2007/0001563 | A1 | 1/2007 | Park et al. | |
| 2008/0087053 | A1* | 4/2008 | Frazier | E05C 7/04 70/95 |
| 2013/0020922 | A1 | 1/2013 | Jang | |
| 2016/0131416 | A1 | 5/2016 | Sankhgond | |
| 2023/0251027 | A1* | 8/2023 | Heidenfelder | F25D 23/067 312/406 |

FOREIGN PATENT DOCUMENTS

| | | | | |
|---|---|---|---|---|
| EP | 2 749 829 | | 7/2014 | |
| EP | 2 749 829 | A2 | 7/2014 | |
| EP | 2 719 981 | B1 | 6/2019 | |
| EP | 2719981 | B1 * | 6/2019 | F25D 23/067 |
| JP | H07-234067 | | 9/1995 | |
| KR | 10-0633027 | | 10/2006 | |
| KR | 20100025139 | A * | 8/2008 | F25D 23/067 |
| KR | 10-2009-0121030 | | 11/2009 | |
| KR | 10-2009-0121030 | A | 11/2009 | |
| KR | 10-2010-0025139 | | 3/2010 | |
| KR | 10-2010-0025139 | A | 3/2010 | |
| KR | 10-2016-0127914 | | 11/2016 | |
| KR | 10-2016-0143190 | | 12/2016 | |

OTHER PUBLICATIONS

Chinese Office Action dated Jan. 14, 2022 issued in CN Application No. 202010975448.0.

European Office Action dated Mar. 1, 2023 issued in Application 21 183 903.0.

* cited by examiner

REFRIGERATOR

CROSS-REFERENCE TO RELATED APPLICATION

This application claims priority under 35 U.S.C. § 119 to Korean Application No. 10-2020-0104315 filed on Aug. 20, 2020, whose entire disclosure is hereby incorporated by reference.

BACKGROUND

1. Field

The present disclosure relates to a refrigerator.

2. Background

A refrigerator is a household appliance that stores various foods, beverages, and other items (hereinafter, "food") for a long time with cold air generated by circulation of refrigerant according to a refrigeration cycle. A cabinet of the refrigerator may include an inner casing defining an inner wall surface of the refrigerator and an outer casing defining an exterior of the refrigerator. Food is stored in a storage space provided in the inner casing.

A manufacturing method of a normal inner casing may include heating and/or vacuum suctioning an acrylonitrile butadiene styrene (ABS) sheet having a plate shape to define the storage space. This method disclosed in Korean Patent No. 10-0633027, Korean Patent Application Publication No. 10-2016-0127914, and Korean Patent Application Publication No. 10-2016-0143190. Using such a manufacturing process of such an inner casing, the inner casing may be formed to be relatively thin at a deeper portion of the storage space.

The manufacturing method may also include coupling the iron plates that form the inner casing and the outer casing made and filling a space between the inner and outer cases with an insulator. However, when a cooling device is installed in the refrigerator, thermal contraction of the inner casing may occur during cooling, and stress concentrated at a specific area may cause cracking. Cracking may mainly occur at approximately a middle height of the storage space, and as a temperature of the storage space decreases, contraction stress increases.

For example, a storage space may have a height of at least 1.5 meters (m). Multiple shelf seating protrusions may be formed at a plurality of different heights of the side walls of the inner casing to hold insertable shelves. However, each of the shelf seating protrusions may cause a thickness of the inner casing to be thinner. When a shelf seating protrusion is formed at an approximate middle portion of the height of the storage space, contraction stress may be concentrated at such a middle portion or height when the storage space is cooled to a below-zero temperature (such as in a freezer compartment), causing cracking of the inner casing.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Referring to FIGS. 1-4, a refrigerator may have a cabinet 100 having an inner casing 110 defining a storage space where food or other items may be stored. The storage space may be configured to be divided into a plurality of spaces by a plurality of shelf assemblies 300.

Figure 7:
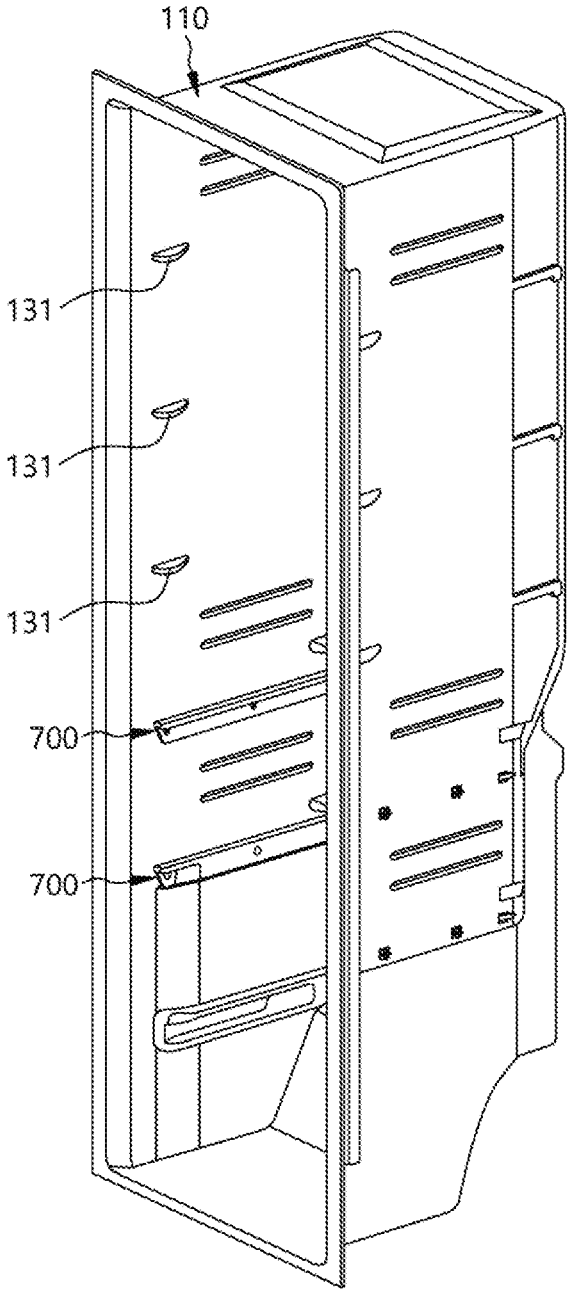
FIG. 7 is a perspective view illustrating an interior of the inner casing of the refrigerator.

Some of the shelf assemblies 300 may be installed by being placed on shelf seating protrusions 131 formed at opposite inner wall surfaces (e.g., left and right inner wall surfaces) of the inner casing 110 (FIG. 7). Other shelf assemblies 300 may be installed by being placed on shelf seating members or supports 700 coupled to the opposite inner wall surfaces of the inner casing 110. Such a configuration may reduce or prevent cracking on the opposite inner wall surfaces of the inner casing 110.

The cabinet 100 may define an exterior of the refrigerator. The cabinet 100 may be configured as a casing having a front opening communicating with the storage space.

Figure 1:
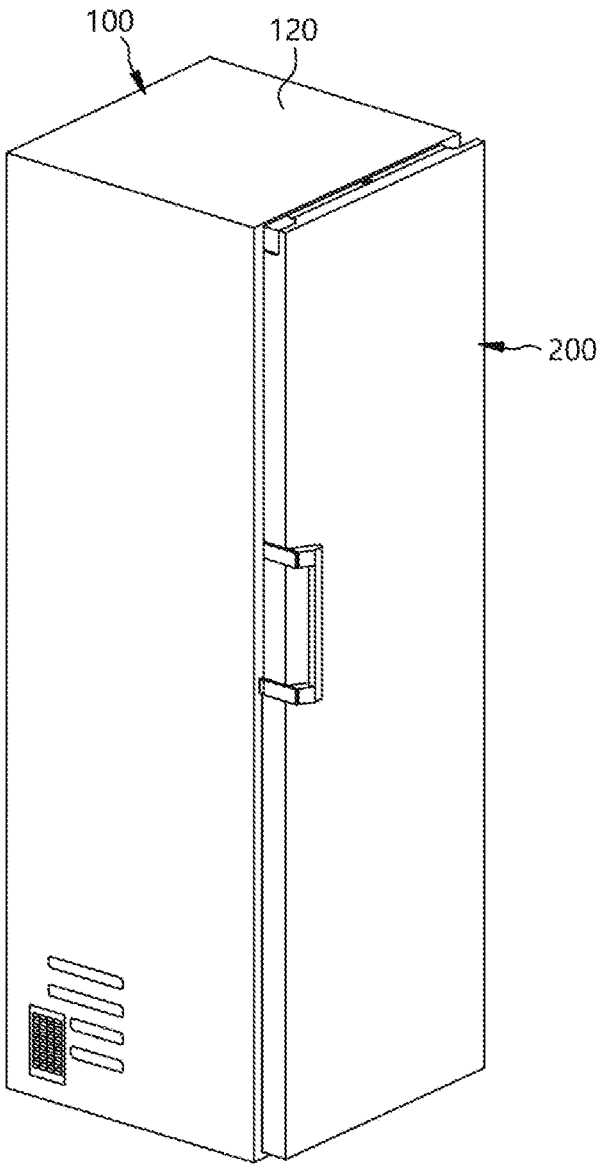
FIG. 1 is a perspective view illustrating an exterior of the refrigerator according to an embodiment.
Figure 2:
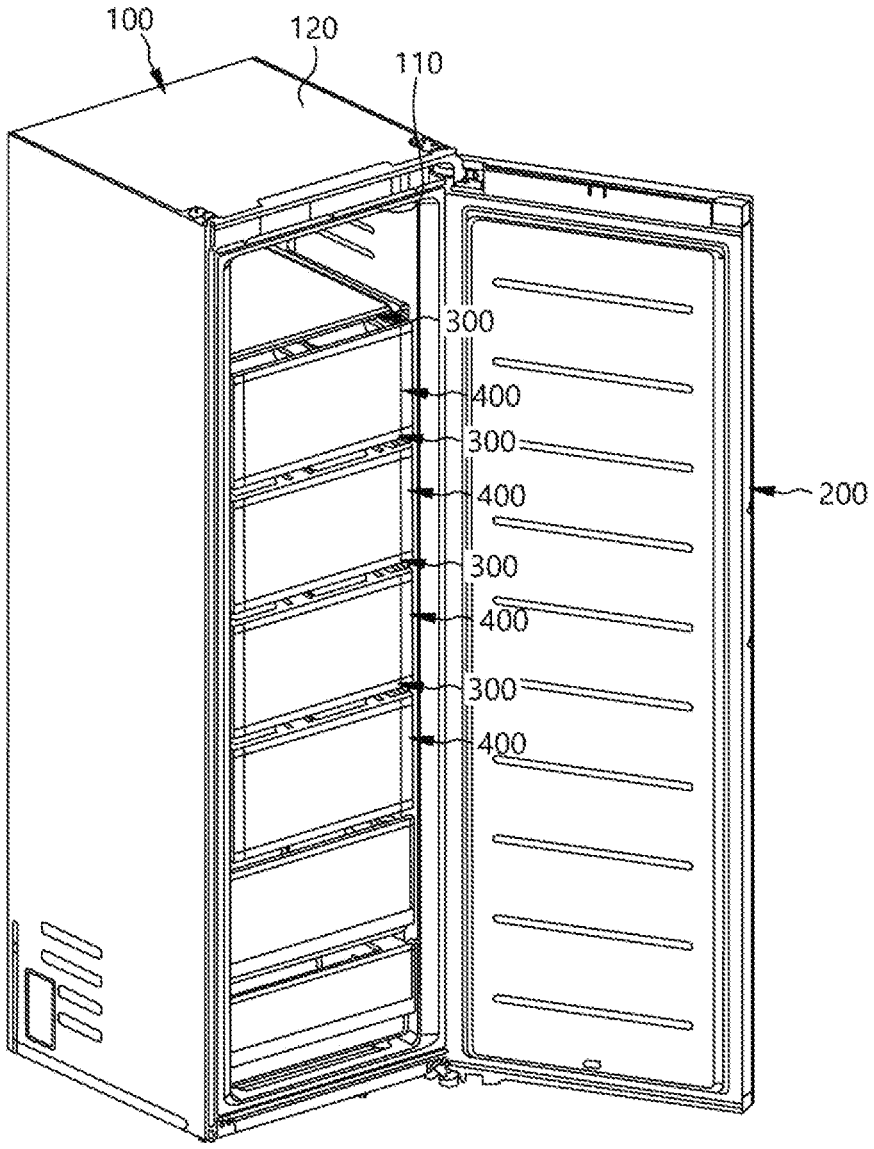
FIG. 2 is a perspective view illustrating where a door is opened to reveal an interior of the refrigerator.
Figure 3:
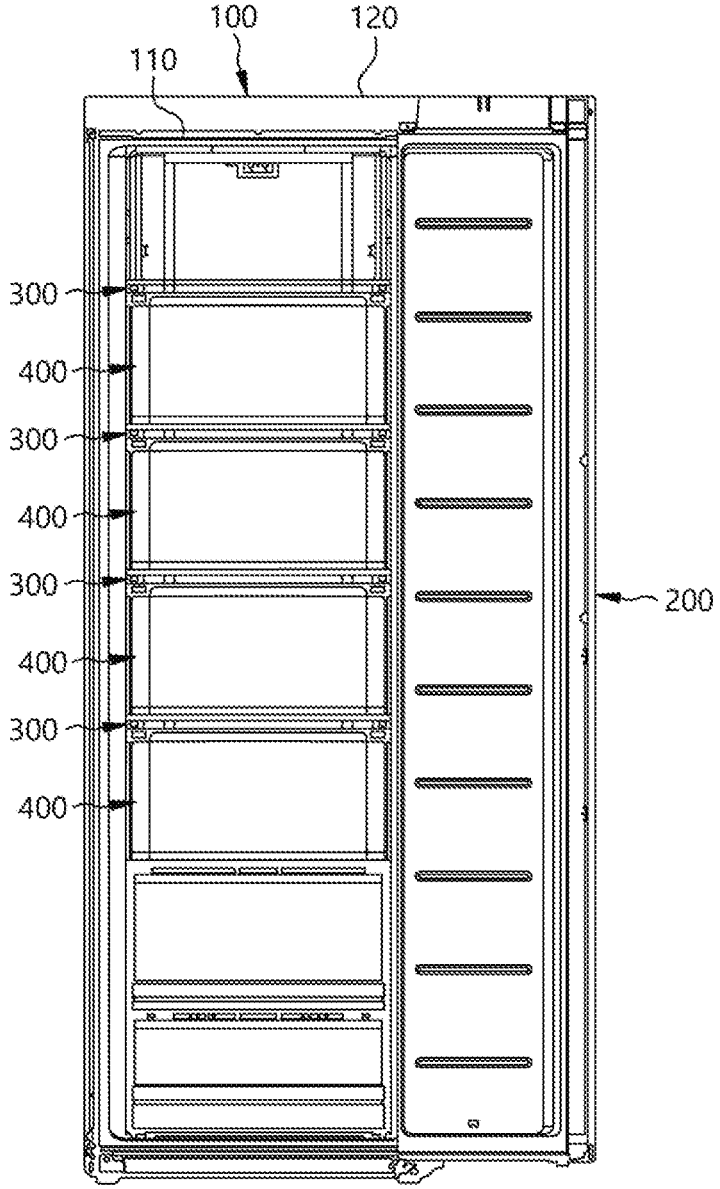
FIG. 3 is a front view illustrating where the door is opened to reveal the interior of the refrigerator.
Figure 4:
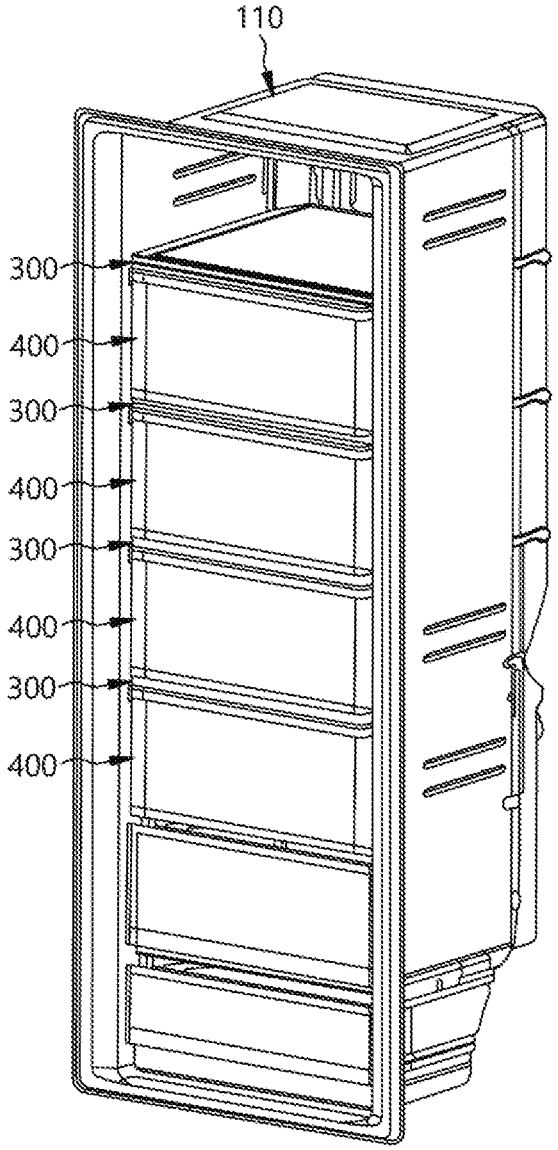
FIG. 4 is a perspective view illustrating installed states of an inner casing, a shelf assembly mounted thereto, and a cold air cover of the refrigerator.

As illustrated in FIGS. 2 to 4, the cabinet 100 may include an outer casing 120 defining an outer wall of the cabinet 100 and the inner casing 110 defining an inner wall of the cabinet 100. An insulator or foam may be filled between the outer casing 120 and the inner casing 110. The outer casing 120 and the inner casing 110 of the cabinet 100 may be configured to be integrated with each other.

The inner casing 110 may be formed of acrylonitrile butadiene styrene (ABS). The inner casing 110 may be manufactured by molding an ABS sheet having a plate shape. Such a manufacturing process may present a high risk of cracking of the inner casing 110, but the shelf seating members 700 of the present disclosure may effectively reduce the risk of cracking of the inner casing 110. When the storage space is formed to have a height of at least 1.5 m, the risk of cracking of the inner casing 110 may be relatively high. In such a case, the shelf seating members 700 provided in the inner casing 110 may be effective in reducing the risk of the cracking.

Although only one storage space is illustrated, embodiments disclosed herein are not limited to a single storage space. For example, the refrigerator may include two storage spaces (e.g., a refrigerating compartment and a freezing compartment) or more.

An evaporator 170 may be inside of the storage space defined by the inner casing 110. The evaporator 170, together with a compressor 151 and a condenser provided in a machine room 150, may be included in a refrigeration cycle configured to generate cold air to keep food stored in the storage space in a frozen state. Such an evaporator 170 may be located at a lower portion or side (below a middle portion) in the storage space defined by the inner casing 110.

A fan motor assembly 180 may be located above the evaporator 170 to circulate cold air. Cold air may be supplied back into the storage space after the cold air in the storage space passes through the evaporator 170. A space at which the evaporator 170 is located may be separated from the storage space of the inner casing 110 by a grill 160. As an example, the evaporator 170 may be an evaporator configured for a freezer compartment used in a kimchi refrigerator or a freezer.

The refrigerator may include a door 200 configured to open and/or close the storage space of the cabinet 100. The door 200 may be a swinging door or a drawer-type door. In addition, the door 200 may be configured as one door or as at least two doors (e.g., a French door). As shown in the drawings, the door 200 may be provided as one swinging door.

Each of the shelf assemblies 300 may be configured to divide the storage space of the inner casing 110 into a plurality of spaces. For example, there may be two shelf assemblies 300. A space may be defined between the cabinet 100 and one of the shelf assemblies 300, and another space may be defined between the shelf assemblies 300.

Figure 5:
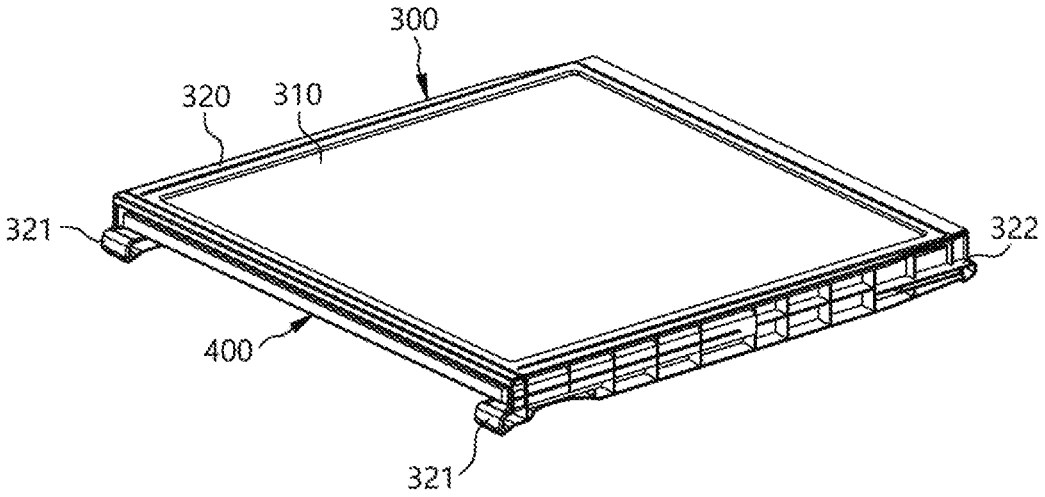
FIG. 5 is a perspective view illustrating the shelf assembly of the refrigerator.
Figure 6:
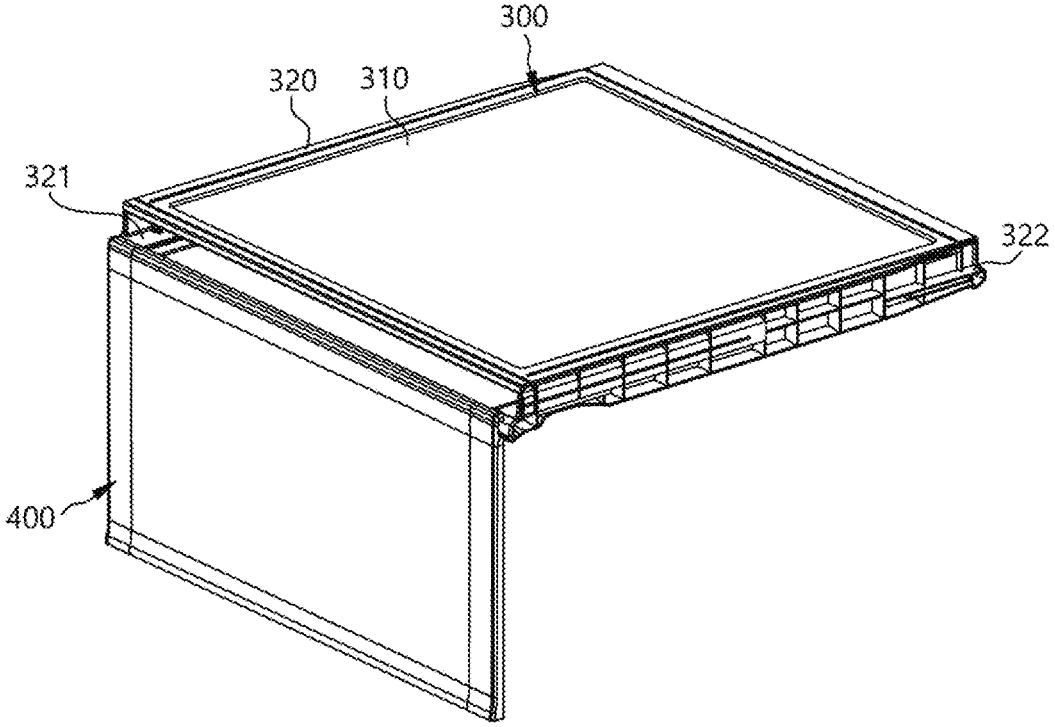
FIG. 6 is a perspective view illustrating where the cold air cover is withdrawn from the shelf assembly of the refrigerator.

As illustrated in FIGS. 5 and 6, each shelf assembly 300 may include a shelf 310 and an edge frame 320. The shelf 310 may be made of a transparent or translucent material (e.g., glass or plastic) so that the user may easily see contents stored in the storage space.

The edge frame 320 may be formed along the edge of the shelf 310 and be configured to be installed on the shelf seating protrusions 131. For example, the shelf 310 may be provided as a plate configured to be seated on the shelf seating protrusions 131. With such an arrangement, however, a weight of stored goods may be concentrated on the edge frame 320 and on the shelf seating protrusions 131, and the shelf 310 may be damaged. In consideration of this risk of damage, the edge frame 320 may be molded and formed to be integrated with the shelf 310. Alternatively, the edge frame 320 and the shelf 310 may be manufactured separately and later combined.

Coupling protrusions 322 may be formed on opposite outer wall surfaces of the edge frame 320. The coupling protrusions 322 may be configured to be inserted into and installed in repressed grooves 132 formed on opposite inner wall surfaces (e.g., left and right wall surfaces) of the inner case 110. Each of the coupling protrusions 322 may be formed at a rear of the outer wall surfaces of the edge frame 320, and the repressed grooves 132 may be similarly formed at a rear of the inner wall surfaces of the inner case 110.

A cold air cover 400 may be mounted to each shelf assembly 300. The cold air cover 400 may cover a front of each space between adjacent shelf assemblies 300 to reduce an unwanted outflow of cold air present in each space. The cold air cover 400 may be formed of a flat plate of a transparent or translucent material (e.g., glass or plastic) so that contents inside of the space may be readily seen.

The cold air cover 400 may be configured to be received in the shelf assembly 300 such that the front of the space located under the shelf assembly 300 is exposed and opened, or to be withdrawn from the shelf assembly 300 to cover the front the space located under the shelf assembly 300. At least one guide 321 to facilitate installation of the cold air cover 400 may be formed at a lower portion of the edge frame 320.

The at least one guide 321 may include two guides spaced apart from each other at opposite lower sides of the edge frame 320. Opposite ends of the cold air cover 400 may slide along an upper surface of the guides 321 to be received in a space between the guide 321 and the edge frame 320. When the cold air cover 400 is received in the space between the guide 321 and edge frame 320, the space between adjacent shelf assemblies 300 may be exposed.

Referring to FIGS. 5-9, the shelf assembly 300 may be placed on on the shelf seating protrusions 131 to be installed. Each of the shelf seating protrusions 131 may be formed on opposite (left and right) side wall surfaces of the inner casing 110. The opposite (left and right) edges of the shelf assembly 300 may be placed on and supported by the shelf seating protrusions 131.

The shelf seating protrusions 131 may be provided at front portions or sides of the opposite side wall surfaces of the inner casing 110 and may be configured to support a front lower surface of the shelf assembly 300. Each of the repressed grooves 132 may be formed behind the shelf seating protrusion 131 such that the coupling protrusion 322 of the shelf assembly 300 is inserted and/or slid along the repressed groove 132. Front portions of the opposite sides of the shelf assembly 300 may be placed on the shelf seating protrusions 131, and the rear portions of the opposite sides of the shelf assembly 300 may be inserted to and fixed in the repressed grooves 132.

However, an arrangement of the shelf seating protrusions 131 and the repressed grooves 132 is not limited. For example, the shelf seating protrusions 131 may be formed both front and rear portions, respectively, of the opposite side wall surfaces of the inner casing 110, and the repressed grooves 132 may be formed at a middle section (with respect to the front-rear direction) or omitted. As another alternative, repressed grooves 132 may be formed at both front and rear portions, respectively, of the opposite side wall surfaces of the inner casing 110, and the shelf seating protrusions 131 may be formed at a middle section or omitted. In yet another alternative, positions of the repressed grooves 132 and shelf seating protrusions 131 may be swapped such that the repressed grooves 132 are formed in front of the shelf seating protrusions 131.

The repressed groove 132 may be advantageous in preventing a vertical shaking or displacement of the shelf assembly 300. The shelf seating protrusion 131 may be advantageous in facilitating a mounting of the shelf assembly 300. In consideration of these advantages, the shelf seating protrusions 131 may be formed toward the front of the inner casing 110, and the repressed grooves 132 may be formed toward the rear of the inner casing 110.

Figure 8:
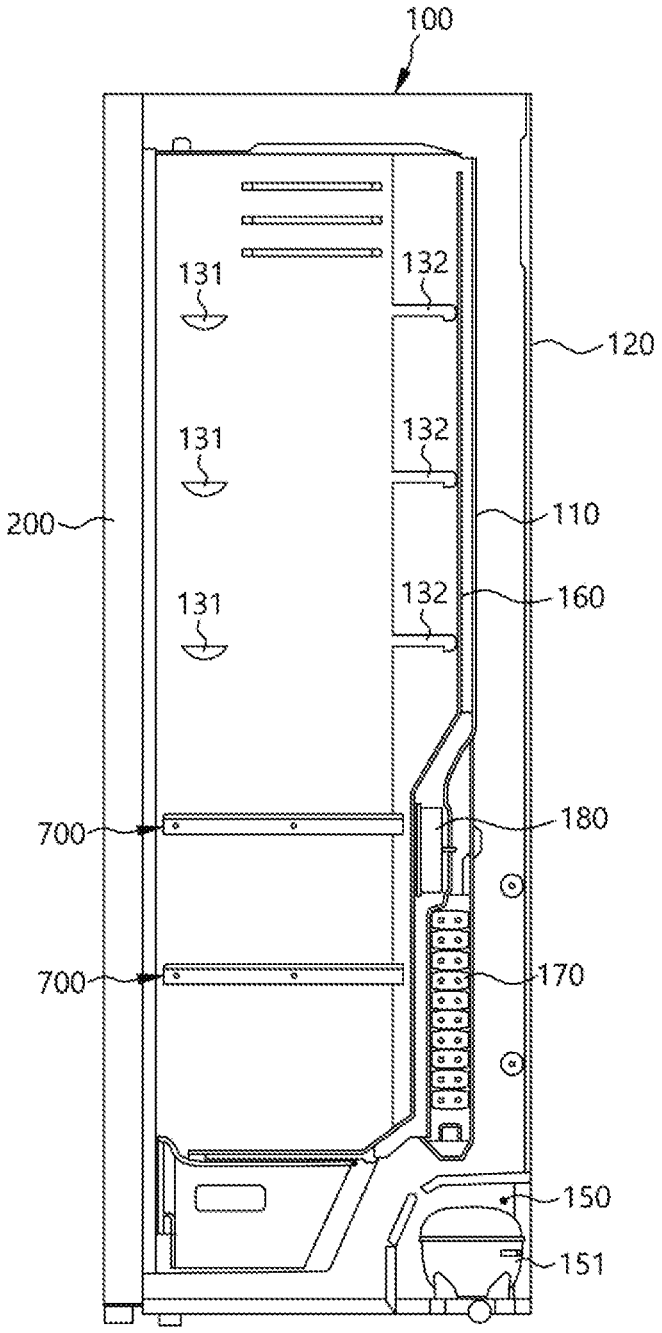
FIG. 8 is a sectional view illustrating a state in which the shelf assembly is not installed in the inner casing of the refrigerator.
Figure 9:
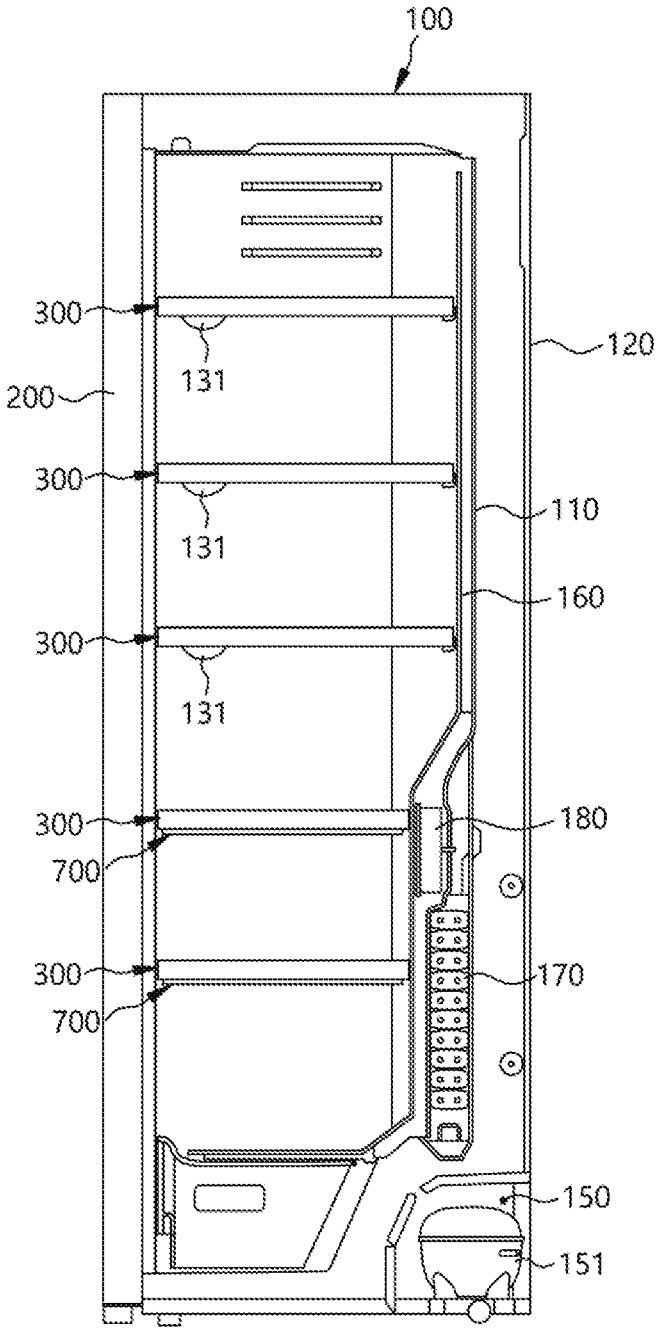
FIG. 9 is a sectional view illustrating a state in which the shelf assembly is installed in the inner casing of the refrigerator.
Figure 10:
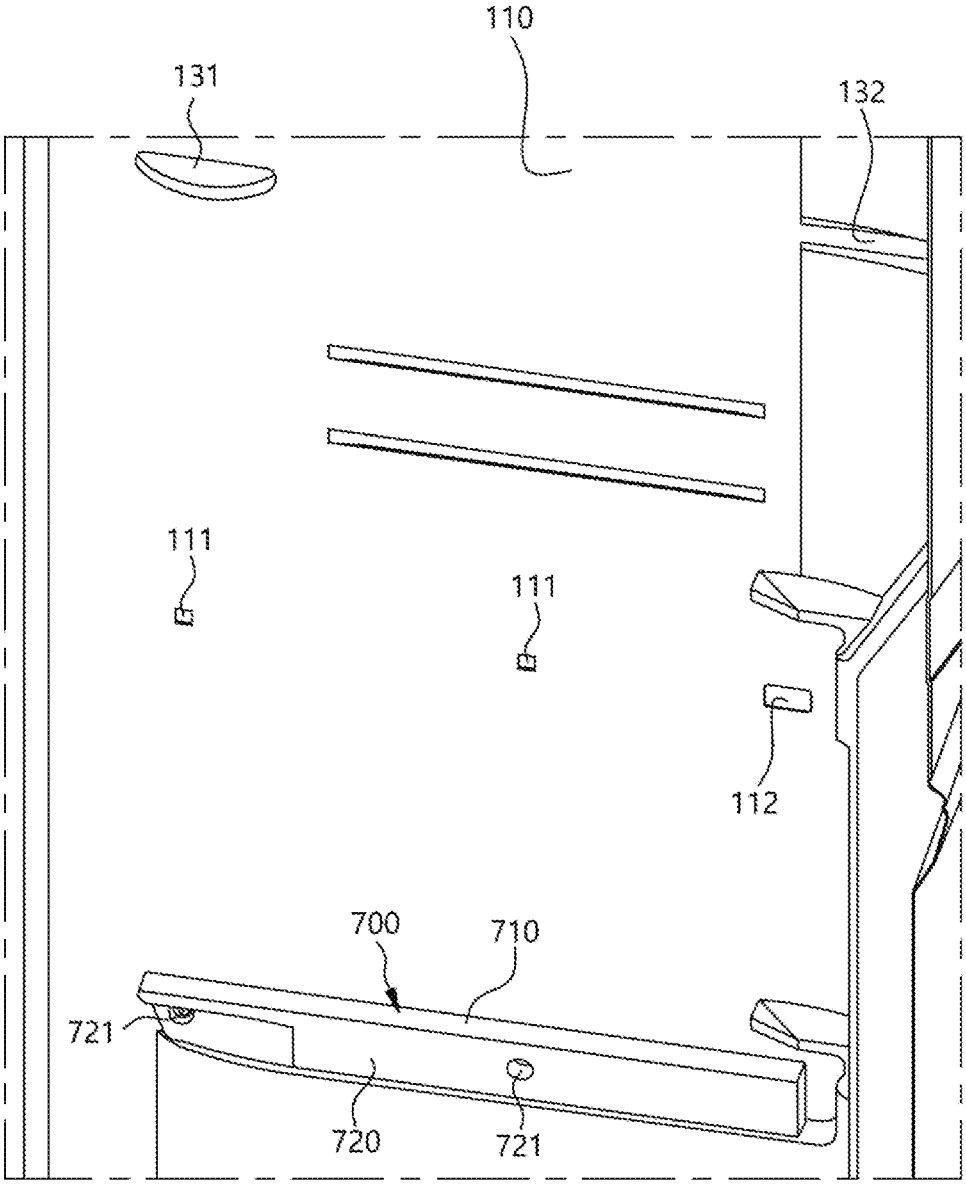
FIG. 10 is an enlarged view illustrating where a shelf seating protrusion is formed and where a shelf seating member is installed in the inner casing of the refrigerator.

As illustrated in FIGS. 8 to 10, the shelf seating protrusion 131 may be configured to have a protruding (left-right) width or length and a vertical thickness that gradually increase toward a middle. An upper surface of the shelf seating protrusion 131 may be configured to be flat. For example, the shelf seating protrusion 131 may resemble a quarter sphere. A weight of the shelf assembly 300 and stored goods placed on the shelf seating protrusion 131 may be sufficiently supported while maintaining a relatively short front-rear length of the shelf seating protrusion 131.

In consideration of the related art, as a front-ear length of shelf protruding supports (shelf seating protrusions) increases, a risk of cracking may increase. Accordingly, in the present disclosure, such a protruding portion that supports the shelf assemblies 300 may be configured to have shorter front-rear lengths to reduce cracking.

The repressed groove 132 may be configured as a groove having an open front and which is repressed extended rearward. The shelf assembly 300 may be manipulated in forward and rearward directions and may be fitted into the repressed groove 132 during installation.

The shelf seating members 700 may be separate from the shelf seating protrusions 131. The shelf assembly 300 may be placed on the shelf seating member 700.

Referring to FIGS. 11-17, the shelf seating member 700 may support opposite edges of the shelf assembly 300. The shelf seating members 700 may be located opposite side wall surfaces of the inner casing 110 at heights different from heights of the shelf seating protrusions 131.

For example, the shelf seating protrusion 131 may be above a middle height of the inner casing 110, and the shelf seating member 700 may be located below the shelf seating protrusion 131. The evaporator 170 and the fan motor assembly 180 may be installed at the lower rear of the storage space, and a lower portion of the storage space may have a shorter front-tear length than an upper side of the storage space. The opposite side wall surfaces of the inner casing 131 may be shorter in the front-rear direction at the lower portion corresponding to where the evaporator 170 and fan motor assembly 180 are located. When the shelf seating protrusion 131 is formed at a lower portion of the side wall surface of the inner casing 101 where the front-rear length is shorter, contract stress may be increasingly concentrated during temperature changes, and a risk of cracking may increase.

Accordingly, the shelf seating protrusion 131 may not be formed at the lower portion of the opposite side wall surfaces of the inner casing 110 where the front-rear length is relatively shorter. Instead, the separate shelf seating member 700 may be installed at the lower portion of the storage space to reduce cracking.

Alternatively, if the upper portions of the opposite side wall surfaces of the inner casing 110 are relatively shorter in the front-rear direction due to a placement of the evaporator 170 and/or the fan motor assembly 180, or other factors, the shelf seating member 700 may be installed at the upper portion of the storage space.

When the inner casing 110 has an approximate height of at least 1.5 m, contraction stress may be concentrated at the middle portion of the inner casing 110. In consideration of this concentrated stress, when the shelf assembly 300 is designed to be located at the middle portion of the inner casing 110, the separate shelf seating member 700 may be provided at a corresponding position to support the shelf assembly 300.

The shelf seating member 700 may be configured to be longer than the shelf seating protrusion 131. The shelf seating protrusion 131 may be configured to have a front-rear length less than half as long as the front-rear length of the shelf assembly 300 such that cracking may be reduced. The shelf seating member 700, however, may not increase the risk of cracking and thus may be configured to have a front-rear length at least length half as long as the front-rear length of the shelf assembly 300.

The shelf seating members 700 may be configured to be integrated with the opposite side wall surfaces of the inner casing 110 from the front sides thereof to rear sides thereof such that the shelf seating members 700 support lower surfaces of opposite ends of the shelf assembly 300. The shelf seating members 700 may also reinforce a portion of the inner casing 110 with which the shelf seating member 700 is installed in close contact.

The shelf seating members 700 may be manufactured separately from the inner casing 110 and then configured to be fixed to the inner wall surfaces of the inner casing 110. The shelf seating members 700 may be configured to be fixed to the side wall surfaces of the inner casing 110 by adhesive, a screw 701, etc.

Such an arrangement may be configured to reduce a risk of damage or cracking of the inner casing 110 during the mounting of the shelf seating members 700 to the inner casing 110 may be prevented. For example, the shelf seating member 700 may be fastened to the inner casing 110 by the screw 701, and a portion of the shelf seating member 700 may be coupled to the inner casing 110 by being engaged therewith.

In each of the opposite side wall surfaces of the inner casing 110, a coupling hole 111 may be formed at a rear portion of a position at which the shelf seating member 700 is installed, and a hook 730 may be formed at the rear end of the shelf seating member 700. The hook 730 may protrude from the rear end of the shelf seating member 700 and passing through the coupling hole 111.

Figure 11:
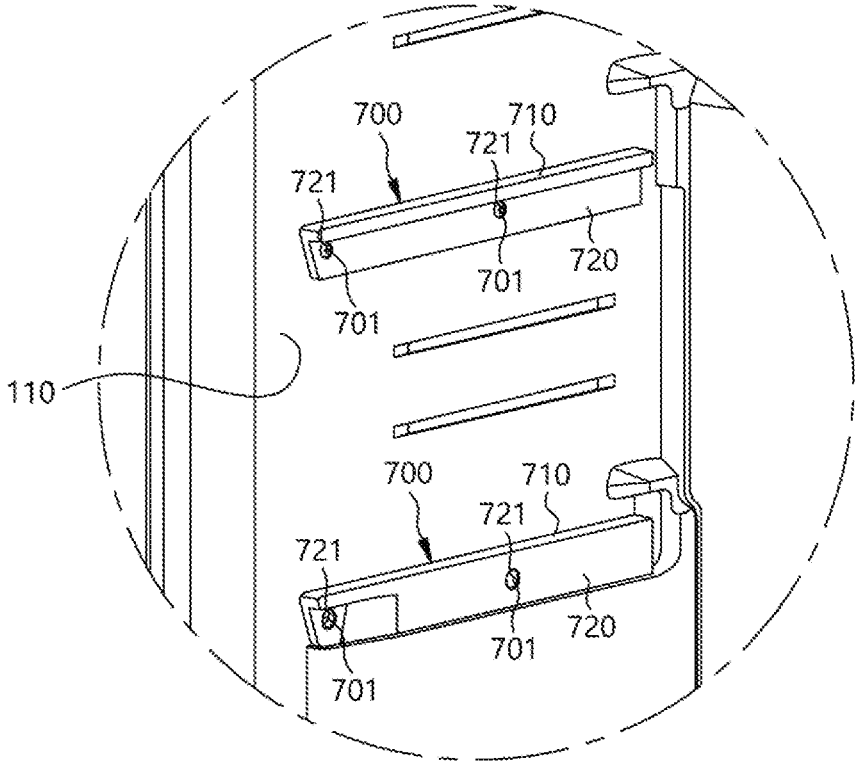
FIG. 11 is an enlarged view illustrating a state when the shelf seating member is installed in the inner casing of the refrigerator.
Figure 12:
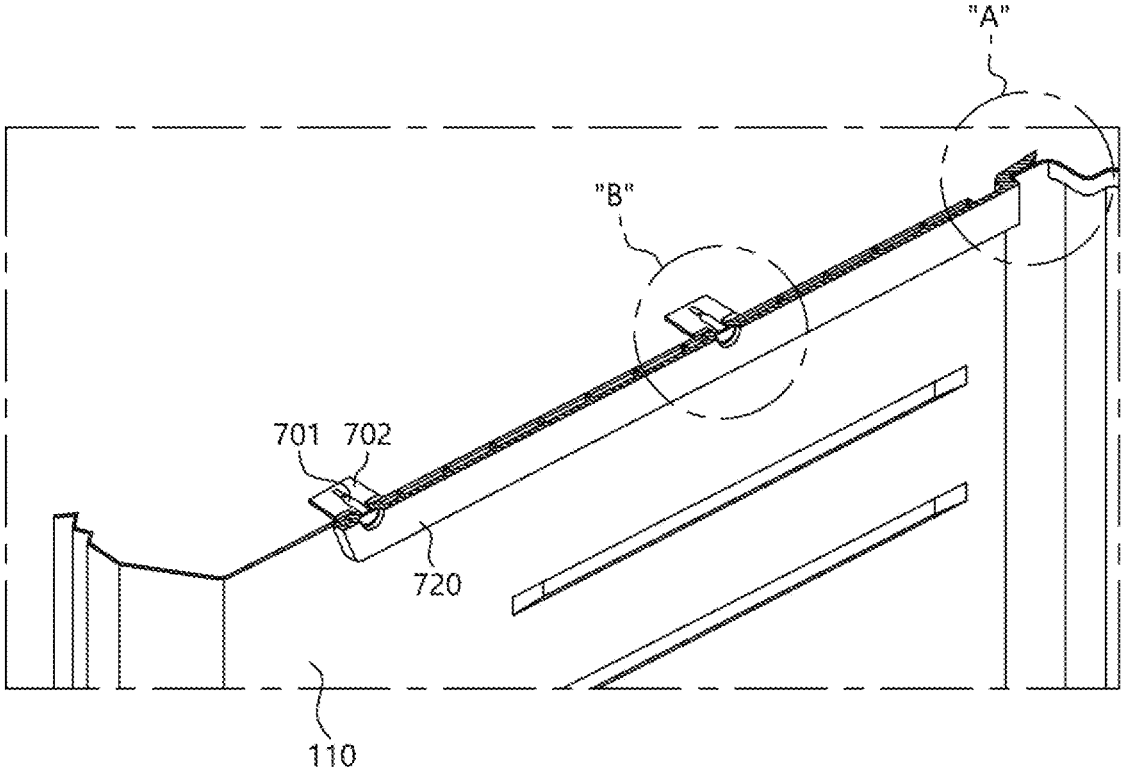
FIG. 12 is an enlarged cross-sectional view illustrating when the shelf seating member is installed in the inner casing of the refrigerator.
Figure 13:
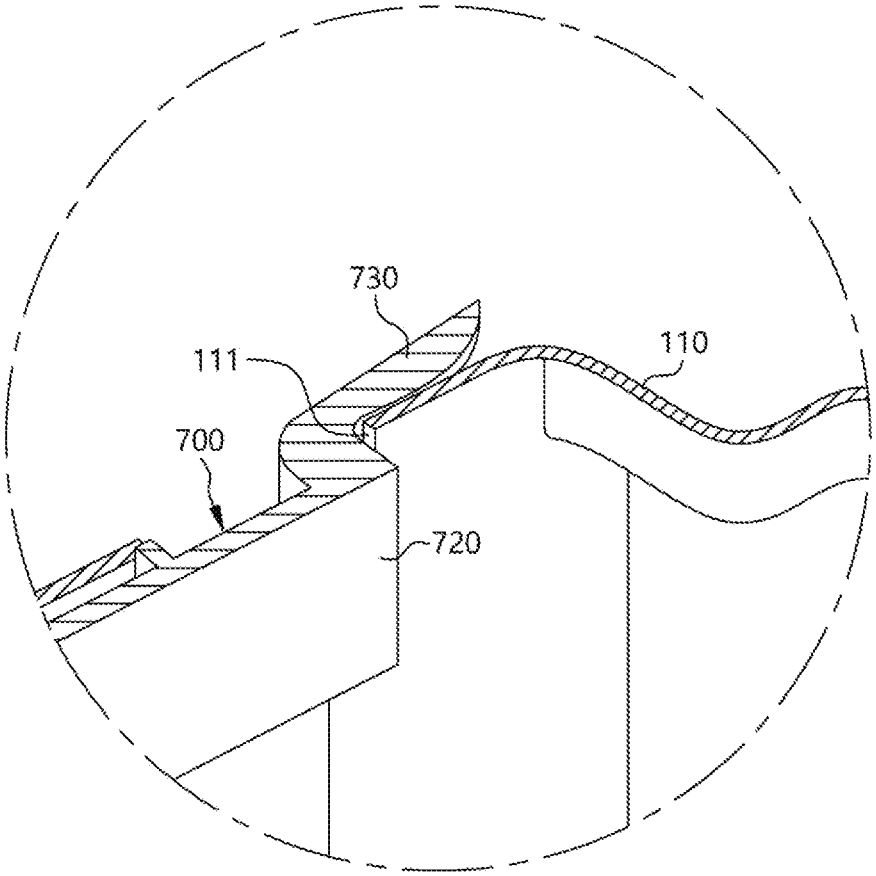
FIG. 13 is an enlarged view of an "A" part in FIG. 12.
Figure 14:
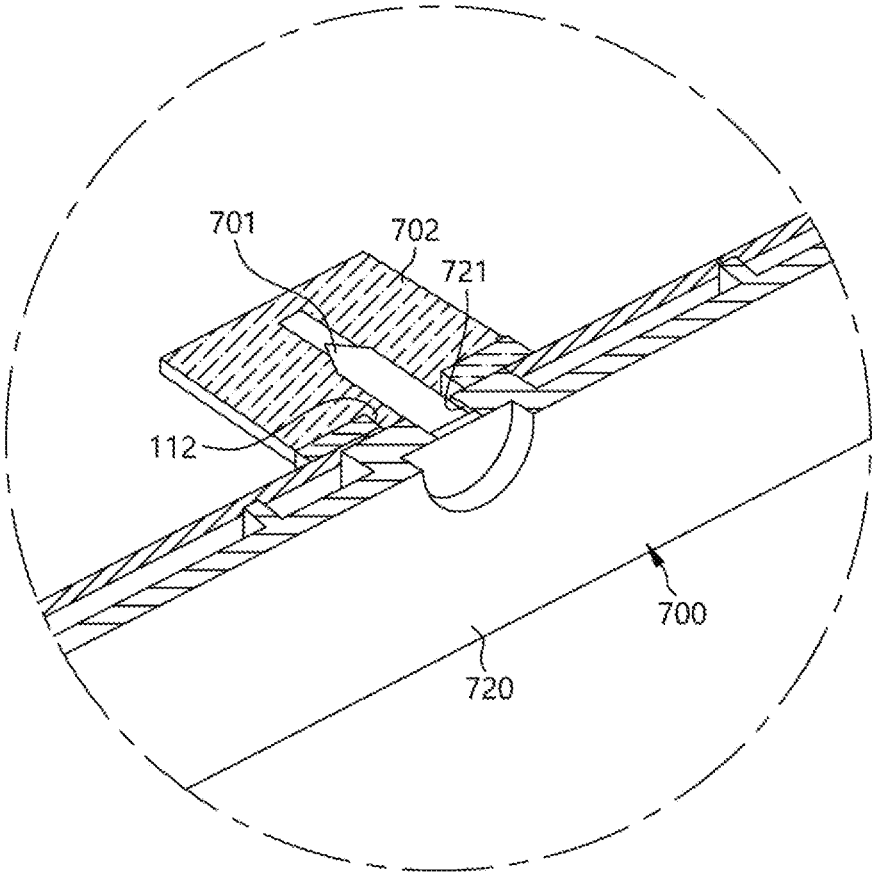
FIG. 14 is an enlarged view of a "B" part in FIG. 12.
Figure 15:
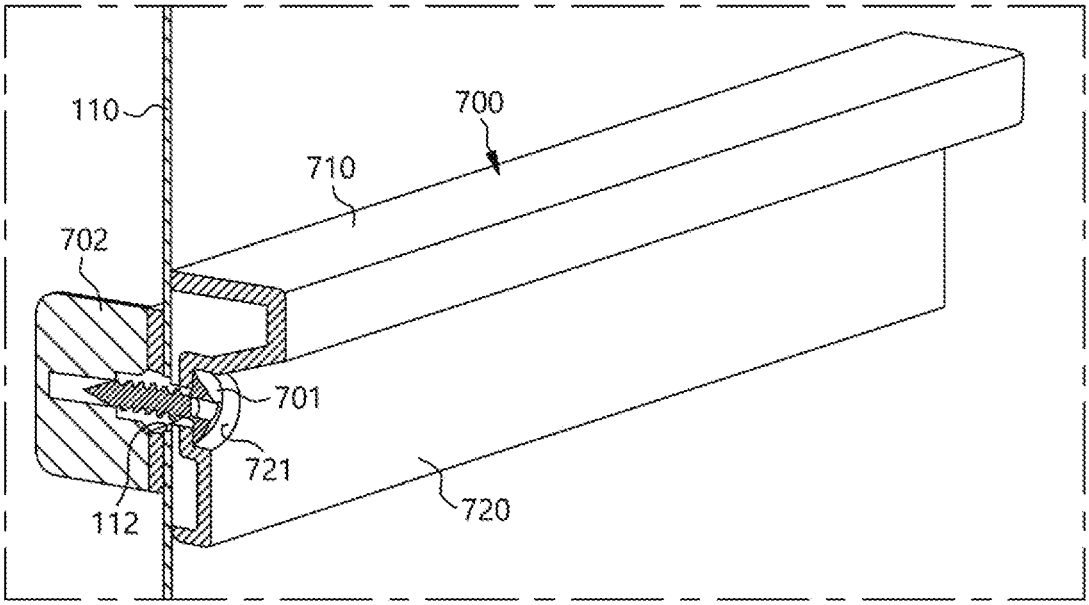
FIG. 15 is an enlarged vertical sectional view illustrating a state in which the shelf seating member is installed in the inner casing of the refrigerator.
Figure 16:
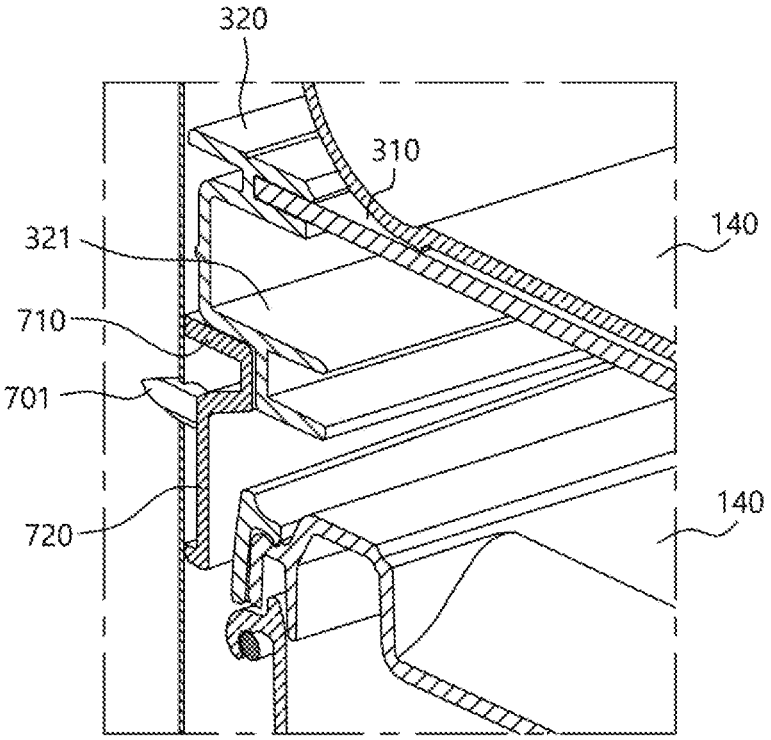
FIG. 16 is an enlarged view illustrating a state in which the shelf assembly is mounted to the shelf seating member of the refrigerator.

The hook 730 may be configured to be bent multiple times (FIG. 13) and to pass through the coupling hole 111 such that the hook 730 is in close contact with the outer wall surface of the inner casing 110. Front and middle portions of the shelf seating member 700 may be fastened to the opposite side wall surfaces of the inner casing 110 by the screw 701 (FIG. 11).

Figure 17:
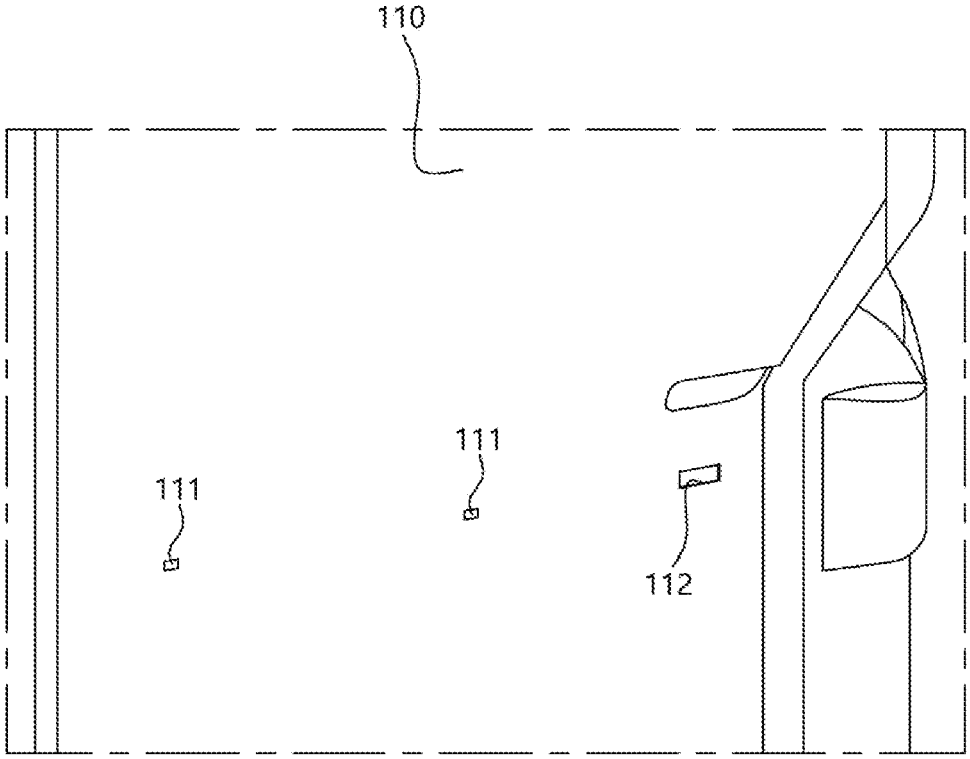
FIG. 17 is an enlarged view illustrating a structure in an outer part of the inner casing where the shelf seating member is installed.
Figure 18:
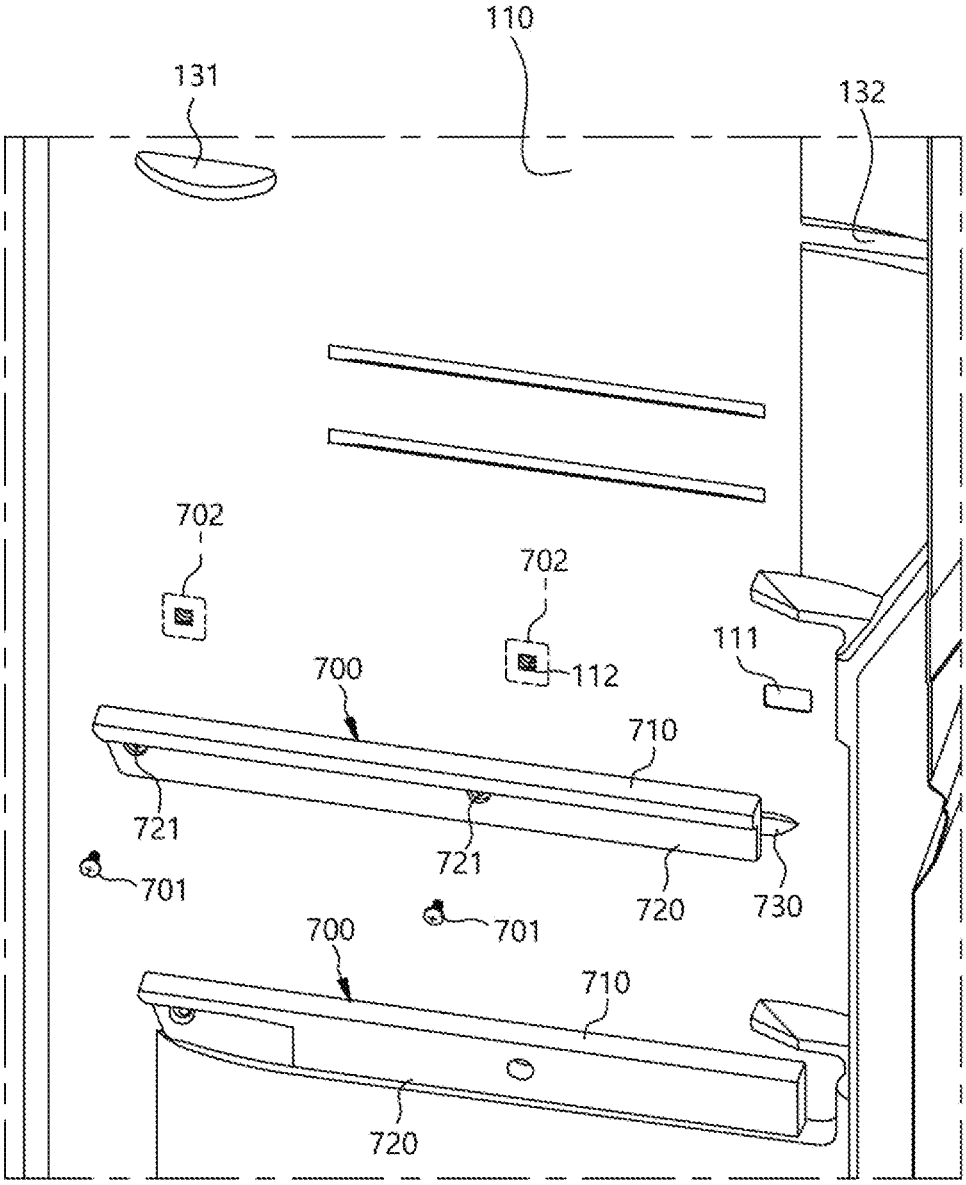
FIG. 18 is an enlarged view illustrating a process of installing the shelf seating member in the inner casing of the refrigerator.

A fastening hole 112 configured to receive the screw 701 to screw the shelf seating member 700 to the inner casing 110 may be formed in the wall surface of the inner casing 110 (FIG. 17). The fastening hole 112 may be formed through the inner casing 110 during screwing of the shelf seating member 700. The shelf seating member 700 may be located at a predetermined or prescribed position by a simple manipulation and then may be securely fastened by the screw 701.

The shelf seating member 700 may include a seating end 710 and a fastening end 720. The seating end 710 may be a part on which each of the opposite ends of the shelf assembly 300 is seated and may be an upper portion of the shelf seating member 700. The upper surface of the seating end 710 may be configured to be a flat surface.

The fastening end 720 may be a portion of the shelf seating member 700 which is screwed to the inner casing 110. The fastening end 720 may extend downward from the seating end 710 such that the fastening end 720 may be in close contact with the inner wall surface of the inner casing 110.

The fastening end 720 may be configured to have a thickness thinner than a thickness of the seating end 710. Since the shelf assembly 300 may be seated on the seating end 710, the seating end 710 may have a sufficient or prescribed seating or surface area. Since the fastening end 720 may facilitate a fastening of the shelf seating member 700, the fastening end 720 may be configured to be relatively thin so as not to take up too much of the storage space.

A horizontal width in the storage space may be maintained by a step of the fastening end 720. A storage box 140 (FIG. 16) (for example, a kimchi container) as large as the horizontal width may be provided in the storage space. A fastening hole 721 may be formed in the fastening end 720 such that the fastening end 720 is screwed to the inner casing 110.

When the inner casing 110 is formed of an extremely thin sheet and the fastening end 720 is also formed to have a thin thickness, the screw 701 may not be stably fastened to the inner casing 110. A fastening bush 702 to fasten the screw 701 may be provided on the outer wall surface of the inner casing 110. The screw 701 may be screwed to the fastening bush 702 and be stably coupled to the inner casing 110.

Hereinafter, a formation process of the shelf seating protrusion 131 described above will be described in detail. First, during the formation of the inner casing 110, the shelf seating protrusion 131 or the repressed groove 132 may be formed to be integrated with the corresponding inner casing 110. Alternatively, at least one of the shelf seating protrusion 131 and the repressed groove 132 may be molded through a separate forming process of the inner casing 110 and later combined with the inner casing 110. The coupling hole 111 and the fastening hole 112 may be formed with the inner casing 110 during the formation of the inner casing 110, or alternatively may be formed through a separate punching or cutting process after the formation of the inner casing 110.

Next, an installation process of the shelf seating member 700 described above will be described in detail. The shelf seating member 700 may be manufactured separately from the inner casing 110. The hook 730 formed at the rear end of the shelf seating member 700 may pass through the coupling hole 111 formed in the rear portion of each of the opposite side wall surfaces of the inner casing 110 and may be exposed to the outside of the inner casing 110.

After passing the hook 730 through the coupling hole 111 from a front side of the coupling hole 111 toward a rear side thereof, the shelf seating member 700 may be in close contact with the inner wall surface of the inner casing 110, and the fastening hole 721 formed in the shelf seating member 700 may be located to correspond to the fastening hole 112 formed in the inner casing 110. The hook 730 of the shelf seating member 700 may be coupled to the coupling hole 111 and the shelf seating member 700 may be located at a predetermined or prescribed position to be screwed.

Figure 19:
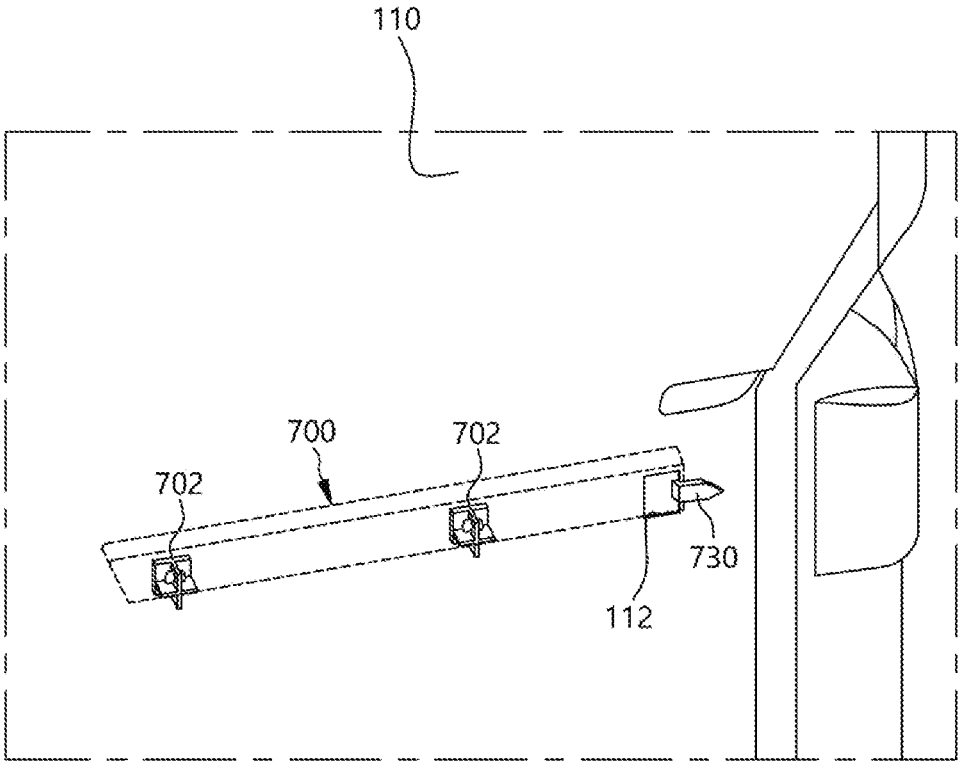
FIG. 19 is an enlarged view illustrating a state in which the shelf seating member is installed on the outer part of the inner casing of the refrigerator.

While the fastening bush 702 is located at each of the outer wall surfaces of the inner casing 110, the shelf seating member 700 may be fastened to the inner casing 110 by the screw 701 (FIG. 19). An installation of the shelf seating member 700 may be completed by this process. In addition, the shelf assembly 300 may be seated on the shelf seating member 700 installed in this manner.

As described above, according to the refrigerator of the present disclosure, in the inner casing 110, a structure on which the shelf assembly 300 is installed may include or be constituted by each of the shelf seating protrusion 131 and the shelf seating member 700 to reduce cracks on the wall surface of the inner casing 110. The shelf seating protrusion 131 may not be formed at the approximate midpoint or center of the height of the storage space defined by the inner casing 110. The separate shelf seating member 700 may be coupled to the inner casing 110 to support the shelf assembly 300 to reduce or prevent deformation of the wall surface of the inner casing 110 due to thermal impact in a manufacturing process or cracking of the wall surface of the inner casing 110 due to a load of the shelf assembly 300 or stored goods.

In each portion of the inner casing 110, the shelf seating member 700 may be located at a portion adjacent to a side at which the evaporator 170 and the fan motor assembly 180 are located. The shelf seating protrusion 131 may be arranged to be located at a side higher than the shelf seating member 700 to facilitate manufacturing and preventing cracking of the wall surface of the inner casing 110.

Embodiments disclosed herein may provide a new type of a refrigerator in which a shelf seating protrusion is not formed at an approximate middle point of height of the storage space and a separate shelf seating member is coupled to the inner casing to support the corresponding shelf so the wall surface of the inner casing may be prevented from being deformed due to thermal impact in a manufacturing process or may be prevented from cracking due to the load of a shelf assembly or stored goods. A plurality of shelf seating protrusions may be formed on opposite side wall surfaces of the inner casing defining the storage space, and apart from the shelf seating protrusions, a separate shelf seating member may be provided.

In addition, the shelf seating protrusions may be arranged at upper sides of opposite side walls of the inner casing, and the shelf seating member may be arranged under the shelf seating protrusions. The shelf seating member may be arranged at a front of an evaporator. The shelf seating member may be at a side higher than the evaporator.

In addition, the evaporator may be located at a portion lower than a middle of the inside of the inner casing. A fan motor assembly may be located at a side higher than the evaporator, the fan motor assembly configured to blow cold air into the storage space.

The shelf seating member may include a plurality of shelf seating members. The shelf seating members may be arranged to be vertically spaced apart from each other and at least one of the shelf seating members may be located at the front side of the fan motor assembly.

In the opposite side wall surfaces of the inner casing, the shelf seating member may be arranged at portions having front-to-rear lengths shorter than front-to-rear lengths of other portions. In the opposite side wall surfaces of the inner casing, the shelf seating protrusions may be arranged at portions having front-to-rear lengths longer than front-to-rear lengths of other portions.

The inner casing may be manufactured by molding an ABS sheet having a plate shape. The storage space defined in the inner casing may be defined by vacuum forming the ABS sheet such that the storage space has the height of 1.5 m or more.

A coupling hole may be formed in the inner casing, and a hook may be formed at a rear end of the shelf seating member by protruding therefrom, so the hook may be coupled to the coupling hole. The hook may be formed by being bent multiple times.

The hook may be installed such that the hook passes through the coupling hole and at least a portion of the hook is in close contact with the outer wall surface of the inner casing. The shelf seating member may be screwed to the inner casing.

The shelf seating member may include a seating end on which each of the opposite ends of a shelf assembly is seated and a fastening end being in close contact with the inner wall surface of the inner casing. The fastening end may be screwed to the inner wall surface of the inner casing.

The screw fastened to the fastening end may pass through the wall surface of the inner casing and may be screwed to a fastening bush provided on the outer wall surface of the inner casing. The fastening end of the shelf seating member may be configured to have a thickness thinner than a thickness of the seating end.

A repressed groove to install a shelf may be formed at each of the opposite side walls of the inner casing, a portion of the rear end of the shelf assembly being inserted to the repressed groove. The repressed groove may be formed at the rear side of the shelf seating protrusion.

The coupling protrusion part may be formed on each of the opposite outer wall surfaces of the shelf assembly by protruding therefrom. The coupling protrusion part may be installed in the repressed groove to install a shelf by being inserted thereto.

The shelf seating protrusions may be formed to support a portion of the front end of the shelf assembly. The shelf seating member may be configured to be longer in a front-rear direction than the shelf seating protrusion.

In the inner casing, a structure on which the shelf assembly is installed may include each of the shelf seating protrusion and the shelf seating member, preventing or reducing the occurrence of cracks on the wall surfaces of the inner casing. The shelf seating protrusion may not be formed at an approximate middle point of the height of the storage space defined by the inner casing, and the separate shelf seating member may be coupled to the inner casing to support the shelf assembly, thereby preventing or reducing deformation of the wall surface of the inner casing due to thermal impact in a manufacturing process or preventing or reducing the occurrence of cracks on the wall surface of the inner casing due to the load of the shelf assembly or stored goods.

Embodiments disclosed herein may be implemented as a refrigerator comprising a cabinet having an inner case defining a storage space and an outer case, the inner case having a first wall and a second wall facing the first wall, wherein an insulator may be filled between the inner case and the outer case, a door to open or close the storage space, an evaporator provided in the storage space, at least one shelf seating protrusion formed on the first wall and at least one shelf seating protrusion formed on the second wall, wherein the shelf seating protrusions protrude in the storage space, at least one shelf seating support fixed to the first wall and at least one shelf seating support fixed to the second wall, and at least one shelf supported by the shelf seating protrusions or the shelf seating supports.

The shelf seating protrusions may be positioned higher than the evaporator. The shelf seating supports may be provided below the shelf seating protrusions. The shelf seating supports may be provided in front of the evaporator.

The evaporator may be provided below a height midpoint of the inner case. A fan may be provided above the evaporator, the fan being configured to guide cold air into the storage space.

The at least one shelf seating support at the first wall may include a plurality of shelf seating supports vertically spaced apart from each other. The at least one shelf seating support at the second wall may include a plurality of shelf seating supports vertically spaced apart from each other. At least one the shelf seating supports may be provided in front of the fan.

The shelf seating supports may be provided at a first height of the first and second walls. The shelf seating protrusions may be provided at a second height of the first and second walls. Front-rear lengths of the first and second walls at the first height may be shorter than front-rear lengths of the first and second walls at the second height.

The inner case may be formed by molding an acrylonitrile butadiene styrene (ABS) sheet having a plate shape. The storage space may be defined by vacuum forming an ABS sheet such that the storage space has a height of at least 1.5 meters (m).

The first and second walls may include a plurality of repressed grooves formed at a rear of the shelf seating protrusions. Each repressed groove may be configured to receive a rear end of the shelf. The rear end of the shelf may include a pair of coupling protrusions configured to be inserted into a pair of repressed grooves among the plurality of repressed grooves. Each of the shelf seating protrusions may be configured to support a front end of the shelf. Each of the shelf seating supports may have a longer front-rear length than each of the shelf seating protrusions.

A coupling hole may be formed in the first and second walls. Each shelf seating support may include a hook configured to pass through the coupling hole. The hook may be bent multiple times from an end of the shelf seating support such that the hook passes through the coupling hole and at least a portion of the hook contacts an outer surface of the inner case.

Each shelf seating support may include a seating panel on which the shelf may be seated and a fastening panel provided below the seating panel to contact the inner case. The fastening panel may be screwed to the inner case.

A fastening bush may be provided on an outer surface of the inner case. A screw passing through the fastening panel and the outer surface of the inner case may be fastened to the fastening bush.

The fastening panel may have a thickness thinner than a thickness of the seating panel. The shelf seating protrusions may be formed at positions that may be not at a height midpoint of the storage space. The shelf seating protrusions may be integrally formed with the first and second walls. The shelf seating supports may be fastened to the first and second walls.

The shelf may include a panel extending between the first and second walls of the inner guide and at least one guide provided below the panel to form an insertion space between the guide and the panel. A cover plate may be configured to be inserted into and withdrawn from the insertion place.

Embodiments disclosed herein may be implemented as a refrigerator comprising a cabinet having an inner case defining a storage space, a door to open or close the storage space, at least one pair of shelf seating protrusions formed on opposite sides of the inner case, wherein the shelf seating protrusions may be formed only above a height midpoint of the storage space, at least one pair of shelf seating supports coupled to the opposite sides of the inner case at a position below the pair of shelf seating protrusions, each shelf seating support including a first panel and a second panel extending in a depth direction of the storage space, wherein the second panel may be fastened to the inner case below the height midpoint of the storage space, and at least one shelf configured to be seated on the first panels of the pair of shelf seating protrusions.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a freezing storage space;

a door configured to open or close the freezing storage space;

an evaporator mounted on a lower portion of the cabinet;

a first shelf detachably mounted on an upper portion of the cabinet; and a second shelf detachably mounted on the lower portion of the cabinet and configured to be available to mount on the upper portion of the cabinet, wherein the cabinet includes:

an outer casing made of at least one iron plate and configured to provide an exterior appearance of the cabinet;

an inner casing manufactured by molding an acrylonitrile butadiene styrene (ABS) sheet having a plate shape, the inner casing having an upper portion and a lower portion to define a first side wall, a bottom wall, a top wall, a rear wall, and a second side wall of the freezing storage space having a height of at least 1.5 meters; and a foam filled between the inner casing and the outer casing, and configured to provide an insulator such that the outer casing and the inner casing of the cabinet are configured to be integrated with each other, wherein the inner casing includes is configured to prevent occurrence of cracks on at least the first side wall by including:

at least one shelf protrusion integrally projecting inwardly from a portion of the first side wall, and the at least one shelf protrusion formed at the upper portion of the inner casing by molding the ABS sheet such that the at least one shelf protrusion causes a thickness of a portion of the first side wall forming the at least one shelf protrusion to be thinner than other portions of the first side wall;

at least one recess formed in the first side wall at the upper portion of the inner casing, and configured to receive a coupling protrusion from the first shelf in order to restrict displacement of the first shelf;

at least one fastening hole formed in the first side wall of the lower portion of the inner casing, and the thickness of the portion of the first side wall forming the at least one shelf protrusion is thinner than thickness of the first side wall of the lower portion of the inner casing; and at least one seating member installed in the first side wall of the lower portion of the inner casing by at least one screw being inserted into the at least one fastening hole, wherein the first shelf is detachably mounted on the at least one shelf protrusion and coupled to the at least one recess, and the second shelf is detachably mounted on the at least one seating member.

2. The refrigerator of claim 1, wherein the at least one shelf protrusion is positioned higher than the evaporator.

3. The refrigerator of claim 1, wherein the at least one seating member is provided below the at least one shelf protrusion.

4. The refrigerator of claim 1, wherein the at least one seating member is provided in front of the evaporator.

5. The refrigerator of claim 1, wherein:

the evaporator is provided below a height midpoint of the inner casing, and a fan is provided above the evaporator, the fan being configured to guide cold air into the storage space.

6. The refrigerator of claim 5, wherein:

at least one of the seating members at the first side wall includes a plurality of shelf seating supports vertically spaced apart from each other;

a plurality of additional seating members installed in the second side wall are vertically spaced apart from each other; and at least one of the plurality of additional seating members is provided in front of the fan.

7. The refrigerator of claim 1, wherein:

the at least one seating member is provided at a first height of the inner casing, the at least one shelf protrusion is provided at a second height of the inner casing, and front-rear length of the first side wall of the inner casing at the first height is shorter than front-rear length of the first side wall of the inner casing at the second height.

8. The refrigerator of claim 1, wherein:

the at least one recess is formed at a rear of the at least one shelf protrusion at the first side wall, and each of the at least one recess is configured to receive a rear end of the first shelf.

9. The refrigerator of claim 8, wherein the rear end of the first shelf includes a pair of coupling protrusions configured to be inserted into the at least one recess at the first side wall and at least another one recess at the second side wall.

10. The refrigerator of claim 8, wherein each of the at least one shelf protrusion is configured to support a front end of the first shelf.

11. The refrigerator of claim 1, wherein each of the at least seating member has a longer front-rear length than each of the at least one shelf protrusion.

12. The refrigerator of claim 1, wherein:

a coupling hole is formed in the inner casing, and the at least one seating member includes a hook configured to pass through the coupling hole.

13. The refrigerator of claim 12, wherein the hook is bent multiple times from an end of the at least one seating member such that the hook passes through the coupling hole and at least a portion of the hook contacts an outer surface of the inner casing.

14. The refrigerator of claim 1, wherein the at least one seating member comprises:

a seating panel on which the first shelf is seated; and a fastening panel provided below the seating panel to contact the inner casing.

15. The refrigerator of claim 14, wherein the fastening panel is screwed to the inner casing.

16. The refrigerator of claim 15, wherein a fastening bush is provided on an outer surface of the inner casing, and a screw passing through the fastening panel and the outer surface of the inner casing is fastened to the fastening bush.

17. The refrigerator of claim 14, wherein the fastening panel has a thickness thinner than a thickness of the seating panel.

18. The refrigerator of claim 1, wherein the at least one shelf protrusion is formed at at least one position that is not at a height midpoint of the storage space.

19. The refrigerator of claim 1, wherein:

the second shelf includes a panel extending between the first and second side walls of the inner casing and at least one guide provided below the panel to form an insertion space between the guide and the panel, and a cover plate is configured to be inserted into and withdrawn from the insertion space.

* * * * *